United States Patent [19]

Tamaoki et al.

[11] 4,261,373

[45] Apr. 14, 1981

[54] TOBACCO FILTERS AND METHOD FOR FORMING SAME

[75] Inventors: Akimichi Tamaoki; Shinichiro Tanaka, both of Yokohama; Susumu Tomioka; Kohichi Kunimune, both of Moriyama, all of Japan

[73] Assignees: The Japan Tobacco & Salt Public Corp., Tokyo, Japan; Chisso Corporation, Osaka, Japan

[21] Appl. No.: 905,884

[22] Filed: May 15, 1978

[30] Foreign Application Priority Data

May 25, 1977 [JP] Japan ..... 52-59851

[51] Int. Cl.[3] ..... A24C 5/50

[52] U.S. Cl. ..... 131/332; 131/340; 131/344; 156/180; 493/43

[58] Field of Search ..... 156/180, 441, 301, 306, 156/182; 264/263, 103, 174, DIG. 48, 137, 258, 263; 425/123; 93/1 C, 77 FT; 131/269, 264, 261 B, 267, 105, 10.7; 19/157, 296, 150, 299, 145.5, 302; 28/172; 428/570, 373, 374, 359, 362; 57/13, 352; 242/157 R

[56] References Cited

U.S. PATENT DOCUMENTS

| | | | |
|---|---|---|---|
| 2,688,380 | 9/1954 | MacHenry | 156/180 |
| 3,144,025 | 8/1964 | Erlich | 131/269 |
| 3,158,984 | 12/1964 | Butler | 57/13 |
| 3,393,685 | 7/1968 | Mumpower et al. | 131/267 |
| 3,558,392 | 1/1971 | Goodenou et al. | 156/180 |
| 3,645,819 | 2/1972 | Fujii et al. | 156/296 |
| 3,773,883 | 11/1973 | Labbe et al. | 131/261 B |
| 4,173,504 | 11/1979 | Tomioka et al. | 156/180 |

FOREIGN PATENT DOCUMENTS

| | | |
|---|---|---|
| 46-277 | of 1971 | Japan . |
| 50-160500 | 12/1975 | Japan . |

*Primary Examiner*—Michael W. Ball
*Attorney, Agent, or Firm*—Fred Philpitt

[57] ABSTRACT

Molding tobacco filters having a variety of cross-sections which are practically useful in providing various preferable effects such as improvement in pressure drop, balanced adsorption of smoke component or the like, are provided according to a method which is characterized in forming fiber bundles of composite fibers consisting of a first and a second component by themselves, or a mixture of at least 20% by weight (based upon the total fiber mixture) of said composite fibers and another kind of fibers so as to give a variety of cross-sections to said fiber bundles, and subjecting said fiber bundles to heat-treatment at a temperature lower than the melting point of the first component but higher than the melting point of the second component to stabilize the structure by the self-adhesion of the second component; the first component of a fiber forming polymer and the second component consisting of one or more kinds of polymer having a melting point lower than that of the first component by 10° C. or more, being disposed in side-by-side or sheath and core relationship so as to give a circumferential ratio of 50~100% of the fiber cross-section.

16 Claims, 5 Drawing Figures

TOBACCO FILTERS AND METHOD FOR FORMING SAME

DESCRIPTION OF THE INVENTION

This invention relates to a method for producing molding tobacco filters having a variety of cross-sections. More particularly, it relates to a method for producing molding tobacco filters having a variety of cross-sections in which fiber-bundles are stabilized by forming them into a variety of cross-sections by way of the inter-fibrous self-adhesion of heat-adhesive composite fibers.

Among conventional tobacco filters, those having a rod-form which is uniform throughout the entire body, have been the leading type. Those in which adsorption of smoke component has been adjusted to an appropriate value by the selection of materials and shapes such as thickness, crimp, etc., have been manufactured.

Various attempts have been made recently to improve cigarette taste by providing rod-form filters with non-uniform effects such as local difference of looseness or compactness, vacant portions, disposition of various shapes of different kinds of materials to change the direction and flow speed of the smoke passing through filters, and further to improve the pressure drop which increases with the progress of adsorption and further to effect balanced adsorption of smoke component. Hereinafter, "molding tobacco filters" or "molding tobacco filters having a variety of cross-sections" used herein means the molding tobacco filters having a variety of cross-sections in which the above-mentioned effects of non-uniformity have been made. However, there have been only a few of such molding tobacco filters which can be put into practical use and moreover, it is the present status of art that there is a problem in the point how such a tobacco filter can be manufactured easily. The present invention has solved the above-mentioned problem.

The present invention resides in a method for producing molding tobacco filters which is characterized by using fiber bundles of composite fibers consisting of a first and a second component alone or a mixture of at least 20 % by weight (based upon the total fiber mixture) of said composite fibers and another kind of fibers which fiber bundles of composite fibers have been formed so as to give a variety of cross-sections to said fiber bundles; and subjecting said fiber bundles to heat-treatment at a temperature lower than the melting point of the first component but higher than the melting point of the second component to stabilize the structure by the self-adhesion of the second component; the first component of a fiber-forming polymer and the second component consisting of one or more kinds of polymers having a melting point lower than that of the first component by 10° C. or more, being disposed in side-by-side or sheath and core relationship so as to give a circumferential ratio of 50–100% of the fiber cross-section.

According to the method of the present invention, the production of tobacco filters having a variety of cross-sections is extremely easy.

Firstly, a method for producing the composite fibers used in the present invention will be described.

As the first component i.e. higher melting component, a fiber-forming polymer is used. Since relatively fine denier fibers are used for tobacco filters, the use of a fiber-forming polymer having good spinnability is preferable. Even in case of a polymer which cannot be called to be the one which provides good cigarette taste, its influence can be suppressed by making the circumferential ratio of fiber cross-section of the first component smaller and in some case by using it as a core of sheath and core structure.

Illustrative polymers used as the first component, include polyolefins, mainly polypropylene type polymers such as crystalline polypropylene, propylene-ethylene copolymer, propylene-butene-1 copolymer, propylene-ethylene-butene-1 copolymer, etc., polyamide such as nylon 6, nylon 66, nylon 610, nylon 11, nylon 16, etc., and polyester such as polyethylene terephthalate, polytrimethylene terephthalate, polytetramethylene terephthalate, polyethylene oxybenzoate, etc. These polymers can be used not only solely but also in the form of a mixture if it is possible.

As crystalline polypropylene, those which are used for common fibers can be used.

As for melt-flow rate (often abbreviated to MFR) [ASTM D-1238(L)] of polypropylene, those which are to the extent used in common spinning, are useful, and those having MFR of 1~50, preferably 4~20, are preferably used from the viewpoint of spinnability.

As polyolefins, beside the above-mentioned polypropylene type polymers, particularly, medium and low pressure polyethylenes can be used as a first component, but in this case it is preferable to combine therewith, particularly lower melting point polymer e.g. ethylene-vinyl acetate copolymer, saponified product thereof, etc. as a second component.

As the second component i.e. lower melting point component, a polymer having a melting point lower than that of the first component by at least 10° C., preferably more than 20° C. and most preferably more than 30° C. is used.

Illustrative useful second components include ethylene-vinyl acetate copolymer (often abbreviated herein to EVA), saponified products of ethylene-vinyl acetate copolymer (often abbreviated herein to saponified EVA) having an arbitrary saponification degree, polyethylene, ethylene-propylene copolymer, ethylene-butene-1-copolymer, ethylene-butene-1-propylene ternary copolymer, lower polymer of propylene, etc. These are used not only soley but also as a mixture. Since the second component occupies 50% or more of the surface of composite fibers and contacts the smoke of tobacco, the smoke component-adsorbing property thereof gives influence upon this cigarette taste. In this regard, polyethylene, EVA or saponified EVA having higher content of ethylene has preferable adsorption property. If the melting point of the second component is lower, it is possible to lower heat-treatment temperature that much, and so long as there is no obstacle, forming and stabilization by way of a variety of cross-sections of fiber bundles become easier and reduction in production cost can be achieved. From the above-mentioned point, it is particularly preferable that the melting point of the second component be 130° C. or lower. In this regard, EVA and saponified EVA are preferable and polyethylene is also likewise preferable. Particularly, EVA and saponified EVA have strong adhesive power, and adhesion with different kinds of fibers in case of tobacco filters made by mixing composite fibers with other fibers is also strong. From the above-mentioned various points, those particularly preferable as the second component include EVA, saponified EVA and polyethylene which are used solely and a mixture of EVA or saponified EVA and polyethylene.

Hereinafter, properties of each component of composite fibers and a production method of composite fibers in which, as a representative example, a crystalline polypropylene is used as a first component and EVA, saponified EVA or a mixture of these with polyethylene is used as a second component, will be described.

As the EVA used as a second component, those having a vinyl acetate content of 0.5 mol % (corresponding to about 1.5% by weight) or higher is preferable and those having a vinyl acetate content of 1 mol % or higher is most preferably used. From the points of the reduction in the melting point of the second component and the increase in the adhesive power, those having a higher content of vinyl acetate component are preferable, but if it is too high, the melting point of EVA is too low, and the adhesive property increases, which makes difficult the handling and use as a material for forming fiber surface. Thus those having 18 mol % (corresponding to about 40% by weight) or lower, preferably those having 10 mol % or lower, are used. By adjusting the vinyl acetate component in the above-mentioned range, the melting point of EVA can be varied in the range of about 50° C. to about 110° C.

If the melt-index [often abbreviated to MI, and according to ASTM D1238 (E)] of EVA is lower than 1, blending property thereof with polyethylene becomes poorer. If the melt-index is higher than 50, the creation of material like gum in the corner of eye (deposit of degraded resin), decomposition and the like are liable to occur. Accordingly it is preferable to avoid those in such a range.

The EVA used in the present invention, can be used as it is without being saponified, but those which have been saponified to an optional proportion in the range of 0~100 including the case of 100% are preferably used in similar manner.

The above-mentioned EVA or saponified EVA mixed with polyethylene can also be preferably used as a second component. As such a polyethylene, any kinds thereof such as high, medium and low density polyethylenes can be used. It is possible to control the physical properties of objective composite fibers such as melting point, hardness, handle or the like by selecting such polyethylenes properly.

With regard to the mixing ratio of EVA or saponified EVA with polyethylene, so long as the total monomer content of vinyl acetate component and vinyl alcohol component (these two components are often referred to as vinyl monomer component) in the mixed polymer is set to be 0.5 mol % or more or preferably 1% or more based upon the total amount of the monomer constituting the mixed polymer i.e. the sum of the monomer components constituting EVA or saponified EVA and polyethylene, the adhesive power is sufficient. Thus the melting point of the second component can be controlled in the range from about 50° C. which is a lowest melting point of EVA to about 130° C. which is close to the melting point of high density polyethylene. It does not matter even if a small amount of titanium oxide, silica gel or the like is admixed in the composite component, irrespective of whatever the kind of composite component is.

The MI of the second composite component is preferably in the range of 1~50, preferably 10~30 from the spinnability of composite fibers even in case of a mixture with polyethylene similarily as in case of 100% copolymer.

For producing the composite fibers of the present invention, a composite spinning apparatus commonly known, can be used. The melt-spinning temperature is preferably in the range of 200°~350° C. preferably in the range of 230°~300° C. on the first component side and in the range of 160°~280° C. preferably in the range of 180°~250° C. on the second component side. Extruded polymer is wound up at a draft ratio of 100~300 and resulting unstretched composite fibers are stretched to 2~6 times the original length at a temperature of environmental temperature to c.a. 100° C. When a polypropylene having a Q value (Q=Mw/Mn, wherein Mw is a weight average molecular weight and Mn is a number average molecular weight) of 3.5 or lower is used, it is possible to set a draft ratio in the range of 600~3000 at the time of take-up of spinning, and stretching step can be omitted.

When a stretching step is further carried out, the production of fine denier product such as those having a denier to an extent of 1.5 which is preferable for tobacco filters, is easy.

The production of composite fibers consisting of the combinations of first components and second components other than the combination of polypropylene and EVA or the like as illustrated above can be carried out by a composite fiber spinning manner at a spinning temperature depending upon the characteristic properties of individual components and under stretching condition.

The composite ratio of the first component to the second component of the composite fibers used in the present invention is preferably in the range of 30:70~70:30 in order to keep the spinnability and the circumferential ratio of the second component in proper range. As a composite structure, the circumferential ratio of the second component is at least 50%, preferably 60% or higher, most preferably 70% or higher. In case of less than 50%, adhesive power is insufficient because of shortage of contact area of the second component at inter-fiber contact points.

The degree of stability and whether the state is soft or hard, of the fiber bundles stabilized by heat-treatment into a variety of cross-sections, depend mainly upon the distribution and melt-adhesion state of interfiber adhesion points. Accordingly, they vary depending upon the content of composite fibers in fiber bundles, the extent of heat-treatment temperature as well as the circumferential ratio of fiber cross-section of the second component of composite fibers, and hence it is possible to obtain filter having proper hardness and elasticity by adjusting the above-mentioned factors.

When a stretching step is carried out, resultant fibers have crimps in general and crimping degree can be controlled according to stretching condition. Further when stretching step is not carried out, resultant fibers substantially do not have crimps. If necessary, mechanical crimp can be given to either of the fibers. Usually crimps of about 15 ~40 waves per 25 mm are preferably used but the number of crimps can be less proportionally to the decrease of mixing ratio of composite fibers.

As for denier, 0.1 ~10 denier is used but a denier in the range of 0.5 ~5 is particularly preferable.

Composite long fibers thus obtained are used after being cut to a length of 36 ~102, or are used in the form of multifilaments or tows as they are.

The composite fibers thus obtained are made into fiber bundles by themselves or in the form of a mixture with other fibers, in many cases after once made into small fiber bundles. The mixing ratio of the composite fibers must be at least 20% by weight. When the mixing ratio is smaller, the stability attained by adhesion becomes insufficient. Even in case small fiber bundles are combined, there is no trouble in the point of stability so long as composite fibers occupy 20% or more of the total fiber bundles but it is preferable to have composite fibers occupy 20% or more in each of the small fiber bundles. As other fibers, in addition to acetate fibers which have been heretofore used broadly, polyolefin fibers such as polypropylene fibers having a good adsorptivity of nicotine and tar, etc. and other kinds of synthetic fibers, rayons, etc. can be used. Such other fibers are used in the form cut to 36~102 mm length or in the form of tow or multifilaments of long fibers as they are.

In mixing composite fibers with other fibers, when both are used in the state of staple fibers, uniform mixing can be easily carried out by using various kinds of conventional blenders for staple fiber or by passing through a carding machine once or preferably twice or more. When both are used in the state of multifilaments or tows, they are passed through a tow-opener and both the opened fibers are laid one upon another. Uniform mixing can be easily carried out by repeating the above-mentioned operation.

Then methods for stabilizing the fiber bundles thus obtained as above-mentioned by constituting into a variety of cross-sections and subjecting to heat-treatment, will be described. Generally speaking, various methods such as a method in which fiber bundles having been formed into a variety of cross-sections are subjected to heat treatment; a method in which fiber bundles having been heat-treated in advance are formed into a variety of cross-sections; a method in which fiber bundles are stabilized once into a variety of cross-sections, then further constituted into a variety of cross-sections and subjected to heat-treatment; etc., can be used. Further as for a method for constituting a variety of cross-sections any of various methods can be used. Concrete description will be made hereinafter about the method. For example, two or more small fiber bundles consisting of composite fibers alone or of composite fibers and other fibers, are collected into fiber bundles and after heat-treatment, they are formed into filter plugs. As such small fiber bundles, spun yarns of woolen yarns, worsted yarns, cotton spinning yarns, twisted multifilament yarns, (hereinafter these may be referred to as small twisted fiber bundles). Multifilament yarns, slivers, tows, etc. which have practically no twist (e.g. less than about 5 turns/meter in case of 1000 d) (hereinafter these may be referred to as small fiber bundles having no twist) can be used.

Small fiber bundles or collected fiber bundles thereof may be subjected to preliminary heat treatment before completion of a variety of cross-sections if it is necessary. With regard to the embodiments of such a variety of cross-sections formed by combining the above-mentioned small fiber bundles, followings can be illustrated for example (i) fiber bundles formed by collecting only small twisted fiber bundles, (ii) fiber bundles having a structure in which a plurality of untwisted small fiber bundles encircle the above-mentioned fiber bundles (i), and (iii) fiber bundles having a structure in which one or more untwisted small fiber bundles are collected and encircled by twisted small fiber bundles. The cross-sections of tobacco filters thus obtained contain the structure in which small fiber bundles are disposed so as to contact with each other while holding small gaps included therebetween, forming a kind of a variety of cross-sections and are stabilized by heat adhesion.

Further by collecting various kinds of small fiber bundles having different constitutional fibers into one bigger fiber bundle, it is easy to prepare products abundant in variations. Even when such small fiber bundles are collected, a kind of a variety of cross-sections is formed by itself, but in other method for turning into a variety of cross-sections hereinafter described, it is easy to prepare filters much abundant in variations by using small fiber bundles. For example, for forming the configuration of cross-section of a whole tobacco filter into various kinds of shape, fiber bundles are passed through a tube having an aimed cross-sectional shape at the time of collecting fiber bundles while subjecting to heat treatment. For forming one part of cross-section of tobacco filter into various shapes, that part is processed in advance as above-mentioned and subjected to heat treatment and then to bundle collection to form an objective cross-sectional shape. Thereafter other parts are incorporated and heat-treatment, bundle collection and paper wrapping are furthercarried out. The inner and outer layers are formed by using two or more kinds of untwisted small fiber bundles having different finenesses and subjected to heat treatment to obtain tobacco filters having porosities different in inner and outer layers. For holding additives such as various kinds of powdered or granular inorganic or organic material, for example, activated charcoal or the like in tobacco to improve cigarette taste or the like, these additives will be easily fixed by holding the additives in a definite manner in the fiber bundles or small fiber bundles, followed by collecting while heat-treating at the time of forming these bundles.

Although the preparation of tobacco filters having such a variety of cross-section is extremely difficult when an adhesive agent is used, it is easily carried out according to the method of the present invention.

Several methods for collecting bundles by heat-treatment will be described further in detail. In a state appropriate for heating fiber bundles sufficiently according to the constitution of fiber bundles, for example, in various states such as the one wherein the whole fiber bundles are loosened to keep the gaps between fibers or the one wherein each of the small portions constituting fiber bundles is separated from each other or the one wherein each of the small bundles is separated from each other, fiber bundles are passed through a heating zone e.g. a hot wind heater to subject to heat treatment at a temperature higher than the melting point of the second composite component but lower than the melting point of the first component and then through a bundle collecting tube such as a metal tube, a glass tube or the like which has a definite configuration of cross-section to collect the bundles while cooling is carried out at the same time and thus they are stabilized in that shape by forming interfiber self-adhesion points by heat melting. When one part of a bundle-collecting tube is kept in the heated state, it is possible to turn the inside of the tube to a heating zone, or it is possible to adhere the outer circumferential surface of the fiber bundles further firmly by melting, but such a heated state of bundle-collecting tube is not always necessary, and by providing a part of tube which is not in the heated state, subsequently to the heating and bundle-collecting part of the tube, it is possible to carry out the function of cooling in addition to shaping. If necessary, it is possible to add solid powder such as activated charcoal, casein powder, silica gel or the like to fiber bundles in advance in order to fix it to the second component at the time of heat treatment. Thus obtained stabilized fiber bundles formed to have a variety of cross-sections can be used as they are or can be incorporated with other fibers to be wrapped with papers to give tobacco filters.

According to the method of the present invention, the stabilization of the constitution of a variety of cross-sections can be carried out only by heat treatment, and even by this stabilization, the fibrous shape is maintained as it is and since the adhesion is made only by point adhesion, the clearances are not clogged. Thus, according to the method of the present invention, it is extremely easy to constitute the cross-section of tobacco filters in a variety of cross-sections and provision of various kinds of tobacco filters improved in the cigarette taste, percentage removal of nicotine and tar, pressure drop, etc. and abundant in the variety thereof can be made. Particularly, such an embodiment as the tobacco filters in which fiber bundles are constituted with small fiber bundle are interesting on account of their special feature. Further since a plug itself maintains its stabilized shape by heat-adhesion, it is economical that the use of plug paper is unnecessary.

When such composite fibers as those in which ethylene-vinyl acetate copolymer type polymer, or polyethylene having a lower melting point is used as a composite second component are used, processing is extremely easy on account of relatively low heat-treatment temperature and strong adhesive power.

Hereinafter, specific examples and comparative examples are presented which are by no means intended to limit the scope of claim.

The shaping apparatus of tobacco filters used in example 1~7 and methods for using it will be described by referring to the attached drawings.

BRIEF DESCRIPTION OF THE DRAWINGS

In FIG. 1, 1 is a trumpet shaped guide; 2 is a group of a number of trumpet shaped guides arranged in circular form; 3 is a trumpet-shaped inlet; 4 is a heating pipe; 5 is an inlet for heating fluid; 6 is an exit for heating fluid; 7 is an exit tube. The group of guides is used to force fibers to take the arrangement at the peripheral part of the cross-section of the filter. The exit tube 7 is freely exchangeagle and those having various kinds of inside diameter and cross-section shape can be provided. When a fiber bundle of various kinds of constitution has an already completed constitution, it enters the trumpet-shaped inlet 3 as it is alone, or when the fiber bundle is to be in the inside of the filter cross-section, it enters the trumpet-shaped inlet 3 while completing the constitution with other fibers by having other fiber bundles 9 having passed through the trumpet-shaped guides 1 disposed, on the peripheral part of the bundle 8, and then it is heated in a heating tube 4 and the diameter and shape are controlled by the exit tube 7 while completing the heat-adhesion at the same time. If necessary, fiber bundles can be subjected to a preliminary shaping at a relatively low temperature before main shaping but in such a case, 2 shaping apparatuses are used in series to effect shaping continuously. After shaping, they are cut, as they are, or after warpped with a plug paper, to a definite length of filter plug. In the following examples, preparation of filter plugs is described at first, and performance test of the filter plugs of each of the examples will be shown in summarized form.

EXAMPLE 1

Figure 1:
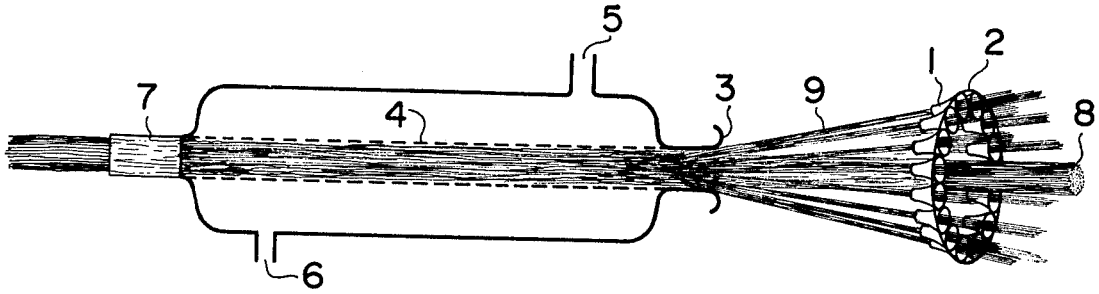
FIG. 1 is the schematic perspective view of the whole shaping apparatus.
Figure 2:
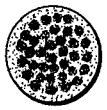
FIG. 2 is a cross sectional view of the tobacco filter of example 2.

Employing as a first component. a crystalline polypropylene (MFR6), and as a second component, a 1:1 (by weight) mixture (content of vinyl monomer based on the total monomers: 3.54% by mol) of EVA (vinyl acetate content, 7.5% by mol; MI, 20; m.p., 90° C.) with a high pressure process polyethylene, composite spinning was carried out by melting the first component at 300° C. and the second component at 180° C. in side-by-side relationship and in a composite ratio of 50:50. The resulting unstretched filament yarns were stretched to 3 times the original length to obtain composite fibers having a filament fineness of 2 d, and a circumferential ratio of fiber cross section of the second component of 85%. The resulting yarns were cut into staples having a length of 64 mm. The resultant staple fibers in an amount of 50% (this % means % by weight unless otherwise indicated) and acetate staple fibers of 3.5 d×64 mm (cross-section shape: Y type) in an amount of 50% were applied to a woolen spinning machine to obtain woolen-spun yarns of 4 metric count (number of times of twists: 3 times/25 mm). Separately, the above-mentioned staple fibers of composite fibers in an amount of 30% and the above-mentioned acetate staple fibers in an amount of 70% were mixed together and passed through a flat-card to obtain silvers of 3 g/m (weight/unit area=Metsuke). Thirty six ends of the above-mentioned woolen yarns in the state held by the two ends of the above-mentioned silver from both the sides thereof were led to a tobacco filter-shaping apparatus to which an exit tube having a length of 20 mm (this length was hereinafter employed unless otherwise indicated), a circular cross-section and an inner diameter of 7.9 mmϕ was attached and , through which they were passed at a rate of 70 m/minute while being heated with heated steam at 130° to effect shaping, followed by paper wrapping by means of a plug machine and cutting to prepare filter plugs. The cross-section of the filters had such a structure that woolen yarns having a comparatively high density were arranged in the state contacting with each other forming a nearly circular shape, and slivers enclosed the yarns with a comparatively rough density, and the whole of the filter was stabilized by the heat adhesion of the composite fibers. The cross-section thereof is shown in FIG. 2.

EXAMPLE 2

From composite fibers of Example 1 (but having different length of 15 mm) in an amount of 30% and the acetate fibers (but having different length of 10 mm) of the same Example in an amount of 70% was obtained a wet process non-woven fabric of 70 g/m$^2$ (Metsuke).

Thirty six ends of the woolen yarns of Example 1 were led to the tobacco filter-shaping apparatus, where they were heated with heated steam at 115° C. and preliminarily shaped by means of an exit tube having a circular cross-section and an inner diameter of 5.9 mmϕ.

The resulting material was wrapped by the above mentioned wet process non-woven fabric, and again led to the tobacco filter-shaping apparatus, where it was heated with heated steam at 130 °C., and passed through an exit tube having a circular cross-section and an inner diameter of 7.9 mmϕ, at a rate of 100m/minute to effect shaping, followed by wrapping with paper and cutting to prepare filter plugs. The cross-section of the filter had a nearly similar structure to that of the product of Example 1. According to this method, it is possible to bring about a variety of tobacco filters by employing non-woven fabrics having various weight per unit area or prepared in various processing manners.

EXAMPLE 3

Figure 3:
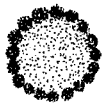
FIG. 3 is a cross sectional view of the tobacco filter of example 3.

A sliver having 12 g/m (Metsuke) and the same fiber structure as in Example 1 was led to the tobacco filter-shaping apparatus to which an exit tube having a circular cross-section and an inner diameter of 6.5 mmϕ, where it was preliminarily shaped into a rod form at 115° C. The resulting material was again led to the tobacco filtershaping apparatus, where 20 ends of the woolen yarns of Example 1 were uniformly arranged around the outer peripheral surface of the rod without any clearance, by passing the rod through trumpet-shaped guides and the resulting material was passed, on heating at 130° C., through an exit tube having a circular cross-section and an inner diameter of 7.9 mmϕ, at a rate of 70 m/minute to effect shaping, followed by cutting as they are to prepare filter plugs. The cross-section thereof is shown in FIG. 3.

EXAMPLE 4

Seven ends of multifilament yarns (2,500 d) of a heat-melt adhesive composite fiber (the first component, polypropylene (MFR 10); the second component, EVA (vinyl content, 15% by mol; MI, 20); composite ratio, 60 (first component): 40 (second component); fineness of 3 d; crimps (spiral), 20 waves/25 mm), and 14 ends of tow (3,000 d) of acetate (15 waves/25 mm), were arranged so as to give a uniform distribution, and while vibration was imparted to each of the mulitifilament yarns or tows in the lateral direction thereof, the fibers of different kinds were blended and collected into bundles, which were then led to the taobacco filter-shaping apparatus, where it was preliminarily shaped into a rod form in the same manner as in Example 3. Except that resultant preliminarily shaped material was substituted for the preliminarily shaped material of slivers, Example 3 was repeated to prepare filter plugs. The cross-sectional structure of the filters was similar to that of the product of Example 3.

EXAMPLE 5

Employing as a first component, a crystalline polypropylene (MFR, 7; Q value, 2.6) and as a second component, a saponified EVA (saponification degree, 80%; content of vinyl component, 12.2% by mol; MI, 17; m.p., 105° C.), composite spinning was carried out by melting the former at 300° C. and the latter at 190° C. in a side-by-side manner in a composite ratio of 50:50 to obtain unstretched yarns of two kinds of fineness of 9 d and 4.5 d. The unstretched yarns of 9 d were collected and stretched to two times the original length at room temperature to obtain multifilament yarns (filament fineness, 4.5 d; number of crimps, 38 waves/25 mm; total denier, 990 d). On the other hand, the unstretched yarns of 4.5 d were collected and stretched to 3 times the original length at 80° C. to obtain multifilaments (filament fineness, 1.5 d; number of crimps, 12 waves/25 mm; total denier, 1,100 d). Twenty ends of the above-mentioned multifilament of 1,100 d were led to a tobacco filter-shaping apparatus to which an exit tube having a circular cross-section and an inner diameter of 5.2 mmϕ was attached, where they were preliminarily shaped into a rod form at 120° C., and the resulting material was again led to the tobacco filter-shaping apparatus, where 20 ends of the above-mentioned multifilaments yarns of 990 d were uniformly arranged around the outer peripheral surface of the rod by passing them through a guide, and the resulting material was passed through an exit tube having a circular cross-section and an inner diameter of 7.9 mm at a rate of 130 m/minute, on heating at 135° C., to effect shaping, followed by cutting as they are to prepare filter plugs, which had a rough, peripheral part (porosity: 90%) and a dense, inner part (porosity: 86%).

EXAMPLE 6

Figure 4:
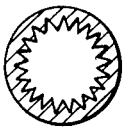
FIG. 4 is a cross sectional view of the exit tube used in the method of example 6.

Example 5 was repeated except that the tobacco filter-shaping apparatus to which an exit tube having a cross-section (pitch of threads, about 1 mm; depth, 1 mm; root-to-root diameter, 7.9 mm) as shown in FIG. 4 and a length of 30 mm was attached, was employed, to obtain filter plugs which had a cross-section of zigzag circumference similar to a corrugated type.

EXAMPLE 7

Figure 5:
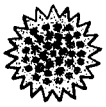
FIG. 5 is a cross sectonal view of the tobacco filter of example 7.

Filter plugs were prepared according to the same procedure with that of Example 1 except that an outlet pipe same with that of Example 6 was used. The filter plugs were a unique tobacco filter in the point that the cross-section thereof had, as shown in FIG. 5, a structure of compactness or loosensess same with that of Example 1 and their circumference was similar to that of corrugated type filters.

EXAMPLES 8~10

Compostie fibers (4d; 12 waves/25 mm; circumferential ratio of cross-section of second component, 80%) consisting of a crystalline polypropylene (MFR 6) and a high density polyethylene (MI 20) and arranged in side-by-side manner were cut to a length of 64 mm and applied to a woolen spinning machine to obtain woolen spun yarns (number of times of twists, 3 times/25 mm) of 4 metric count (corresponding to 2,250 denier). A given number of ends of the yarns (30 ends and 40 ends in the order of Examples 8, 9, and 10), each of the yarns being spaced enough to allow the contact with hot air, was passed through a hot air heating machine (length of heating zone: 3 m) maintained at 145° C., at a rate of 20 m/minute. Thereafrter they were collected and drawn in and passed through a glass tube having a trumpet-shaped inlet having a length of 20 cm, followed by collecting into bundles, shaping, paper-wrapping by means of a plug machine and cutting to prepare filter plugs, which had such a cross-section that a large number of woolen yarns having a comparatively dense texture were arrnged in the state contacting with each other and uncontacted parts formed adequately fine clearances which allowed communication in the longitudinal direction of the filters.

The production of the tobacco filters in any of the above-mentioned Examples could be very easily carried out in any of the cases.

The performance test of the tobacco filters obtained in each of the Examples was carried out according to the following method:

A filter plug was cut to a length of 17 mm to obtain filter tips. One of them were bonded to a tobacco portion obtained by removing a filter tip from "hi-lite" (a trade name of a tobacco cigarette made by Japan Tobacco & Salt Public Corporation), and the resulting material was subjected to smoking by means of a constant-flow automatic machine of a stationary flow amount, under the following standard conditions;

Flow amount: 17.5 ml/sec.

Smoking time: 2 sec./one time

Smoking frequency: One time/min.

Smoking length: 50 mm

The percentages removal of nicotine and tar in the smoke were measured by means of a spectrophotometer and Karl Fischer's moisture titration apparatus, respectively. In addition, pressure drop shown in Table 3 is a value expressed in terms of water column, of pressure drop resistance obtained when air of 17.5 ml/sec. was passed through a filter tip alone.

Further, as for the smoking taste, employing a sample filter tobacco obtained by bonding a filter of the present invention to "hi-lite" according to the above-mentioned method, estimation was carried out by a functional inspection panel of 10 persons.

As for the estimation standard, estimation was carried out so as to give five classes which were converted in marks, as shown in Table 1, and the marks of 10 persons were totaled, and the resulting totals were ranked so as to give five grades, which were expressed by symbols, to give the estimation of smoking taste of the filter, as shown in Table 2.

TABLE 1

| Marks | Contents of estimation |
|---|---|
| 5 | Considerably better than conventional products |
| 4 | Better than conventional products |
| 3 | Same grade with those of conventional products |
| 2 | Worse than conventional products |
| 1 | Considerably worse than conventional products |

TABLE 2

| Total of marks of 10 persons | Symbol of estimate of cigarette taste |
|---|---|
| 45–50 | ⊙ |
| 30–44 | ○ |
| 25–34 | Δ |
| 15–24 | X |
| 14 or less | X X |

The results of the tobacco filter performance tests on the tobacco filters prepared in each of the Examples are shown in Table 3. For comparison, those on a filter on sale made from acetate are also shown.

TABLE 3

| | Weight (g/17 mm) | Pressure drop (mm water column) | Percentage removal (%) nicotine | Percentage removal (%) tar | Cigarette taste |
|---|---|---|---|---|---|
| Example 1 | 0.218 | 57 | 39 | 48 | ⊙ |
| Example 2 | 0.216 | 60 | 40 | 50 | ○ |
| Example 3 | 0.200 | 57 | 34 | 42 | ⊙ |
| Example 4 | 0.203 | 56 | 41 | 45 | ○ |
| Example 5 | 0.115 | 50 | 47 | 55 | ⊙ |
| Example 6 | 0.117 | 49 | 50 | 57 | ⊙ |
| Example 7 | 0.217 | 53 | 44 | 52 | ⊙ |
| Example 8 | 0.154 | 42 | 45 | 48 | ⊙ |
| Example 9 | 0.173 | 60 | 51 | 53 | ⊙ |
| Example 10 | 0.192 | 54 | 49 | 51 | ⊙ |
| Comparative example (commercial acetate filter) | 0.123 | 48 | 29 | 36 | ○ |

What is claimed is:

1. A tobacco filter that comprises a plurality of individual fiber bundles consisting of twisted fiber bundles and untwisted fiber bundles, said bundles being gathered together into a multi-bundle, said individual fiber bundles in the multi-bundle all being readily identifiable in cross section, being positioned in parallel relationship to each other and extending in generally the same longitudinal direction, the fibers in said bundles being fixed in place in said bundles by the heat adhesion of adjacent fibers, The individual fiber bundles in said multi-bundle being fixed in place relative to each other by the heat adhesion of the fibers of one bundle to the fibers of an adjacent bundle, each of said bundles having a small denier, the fibers of each bundle consisting of either (1) composite fibers alone or (2) a mixture of said composite fibers with other kinds of fibers, said composite fibers being in an amount of at least 20% by weight based upon the weight of the mixture, said composite fibers each having a first component consisting of a fiber forming polymer and a second component consisting of at least one polymer having a melting point lower than that of the first component by 10° C. or more, and said first component and said second component being disposed in side-by-side or sheath and core relationship, so that the circumferential proportion of said second component in the fiber cross-section is 50–100%.

2. A tobacco filter according to claim 1 wherein said bundles consist of one or more twisted fiber bundles and a plurality of untwisted fiber bundles, and the former bundles are encircled by the latter bundles to form a nonuniform structure in the fiber cross-section.

3. A tobacco filter according to claim 1 wherein said bundles consist of a plurality of twisted fiber bundles and one or more untwisted fiber bundles, and the latter bundles are encircled by the former bundles to form a nonuniform structure in the fiber cross-section.

4. A method for producing tobacco filters which is characterized by:

(a) forming a plurality of individual fiber bundles consisting of twisted fiber bundles and untwisted fiber bundles, each fiber bundle having a small denier and consisting of either (1) composite fibers that each consist of only a first component and a second component, or (2) a mixture of said composite fibers with other kinds of fibers, said composite fibers being in an amount of at least 20% by weight based upon the weight of the mixture, (b) gathering said plurality of individual fiber bundles into a single multi-bundle structure having the diameter of the desired filter so that all of said individual fiber bundles essentially retain their separate identity when viewed in cross section and are aligned both longitudinally and parallel to each other in either a touching or a closely spaced-apart relationship, (c) subjecting said multi-bundle structure after step (b) to heat-treatment at a temperature lower than the melting point of said first component but higher than that of said second component to thereby stabilize the positional relationship of the individual fiber bundles to each other in the multi-bundle structure as set forth in (b) through the adhesion of the second component portion of some fibers to either the first or second component of other fibers, (d) cooling the heated multi-bundle structure, and then cutting the cooled and dimensionally stabilized multi-bundle structure into filter plugs of definite length, (e) said first component consisting of a fiber forming polymer and said second component consisting of at least one polymer and having a melting point lower than that of said first component by 10° C. or more and said first and second components being disposed in side-by-side or sheath-and-core relationship so that the circumferential proportion of said second component in the fiber cross-section is 50–100%.

5. A method for producing tobacco filters according to claim 4 wherein said first component consists of polyolefin, polyamide or polyester are used.

6. A method for producing tobacco filters according to claim 4 wherein said polyolefin is crystalline polyolefin, propylene-ethylene copolymer, propylene-butene-1 copolymer or propylene-ethylene-butene-1 copolymer.

7. A method for producing tobacco filters according to claim 4 wherein said second component consists of at least one material selected from the group consisting of ethylene-vinyl acetate copolymer, saponified product of ethylene-vinyl acetate copolymer having an arbitrary sapondification degree, polyethylene, ethylene-propylene copolymer, ethylene-butene-1 copolymer or ethylene-butene-1-propylene ternary copolymer.

8. A method for producing tobacco filters according to claim 7 wherein said second component consists of ethylene-vinyl acetate copolymer having a vinyl acetate content of 0.5–18 mol % based upon the total monomer amount of vinyl acetate component and ethylene component, or saponification product thereof or a mixed polymer of any of the foregoing with polyethylene, having a vinyl monomer component of 0.5 mol % or more based upon the total amount of the monomer component.

9. A method for producing tobacco according to claim 4 wherein composite fibers have a circumferential ratio of fiber cross-section of the second component of 70% or more.

10. A method for producing tobacco filters according to claim 4 wherein composite fibers have a first component of polypropylene and a second component of polyethylene, ethylene-vinyl acetate copolymer, a saponification product of said copolymer or a mixed polymer of the foregoing members.

11. A method for producing tobacco filters according to claim 4 wherein said composite fibers are composite staple fibers having a number of crimp value of 15–40 waves/25 mm, a denier of 0.1–10 and a fiber length of 36–102 mm.

12. A method for producing tobacco filters according to claim 4 wherein said composite fibers are tows or multifilaments of the long fibers having a crimps value of 15–40 waves/25 mm, and a denier of 0.1–10.

13. A method for producing tobacco filters according to claim 4 wherein said other kind of fibers are acetate fibers polyolefin fibers or rayon in the form of staple having a length of 36–102 mm or tow.

14. A method according to claim 4 wherein prior to step (b) said individual fiber bundles are subjected to heat-treatment at a temperature lower than the melting point of said first component but higher than that of said second component to thereby stabilize the positional relationship of the individual fiber bundles to each other when they are gathered into a multi-bundle structure through the adhesion of the second component portion of some fibers to either the first or second component of other fibers.

15. A method according to claim 4 wherein said single multi-bundle includes at least one individual twisted bundle and a plurality of untwisted bundles, and the twisted bundles are encircled by the untwisted bundles.

16. A method according to claim 4 wherein said single multi-bundle includes at least one untwisted bundle and a plurality of twisted bundles, and the former is encircled by the latter.

* * * * *